United States Patent [19]

Field

[11] 4,415,788

[45] Nov. 15, 1983

[54] INDUCTION CARTRIDGE

[75] Inventor: Thomas R. Field, Noblesville, Ind.

[73] Assignee: Jenn-Air Corporation, Indianapolis, Ind.

[21] Appl. No.: 271,462

[22] Filed: Jun. 8, 1981

[51] Int. Cl.[3] ..... H05B 9/02

[52] U.S. Cl. ..... 219/10.49 R; 219/447; 219/460; 219/10.67; 219/464

[58] Field of Search ..... 219/10.49 R, 447, 460, 219/464, 461, 432, 433, 523, 443, 451, 457, 10.67, 10.49 R

[56] References Cited

U.S. PATENT DOCUMENTS

| | | | |
|---|---|---|---|
| 3,627,986 | 12/1971 | Anderson | 219/460 |
| 3,740,513 | 6/1973 | Peters, Jr. et al. | 219/10.49 R |
| 3,797,375 | 3/1974 | Cerola | 219/447 |
| 4,042,806 | 8/1977 | McCartney | 219/447 |
| 4,191,875 | 3/1980 | Cunningham | 219/10.49 R |

FOREIGN PATENT DOCUMENTS

| | | | |
|---|---|---|---|
| 52-62745 | 5/1977 | Japan | 219/10.49 R |
| 53-62244 | 6/1978 | Japan | 219/10.49 R |

OTHER PUBLICATIONS

IEEE Transactions on Industry Applications, vol. 1A-9, No. 1, Jan./Feb. 1973, pp. 81-85, (p. 85, col. 1).

*Primary Examiner*—B. A. Reynolds
*Assistant Examiner*—M. M. Lateef
*Attorney, Agent, or Firm*—Richard L. Ward

[57] ABSTRACT

A modular induction cooktop cartridge contains a fan which is interlocked with the panel switches so that whenever an induction unit is operative, air is drawn into the cartridge to cool the solid state electronic components. Air is exhausted in a high velocity discharge to minimize recirculation.

9 Claims, 6 Drawing Figures

INDUCTION CARTRIDGE

BACKGROUND OF THE INVENTION

Magnetic induction heating is based upon transformer theory. Basically, a coil is located beneath the cooktop surface and is used to generate an oscillating, circular magnetic field. When an iron-based pot or pan is placed in the magnetic field, it acts as a shorted transformer secondary which is subject to a high induction current at low voltage. The cookware heats up and cooks its contents in the same manner as conventional ranges and cooktops. It is, however, the heat from the utensil that cooks the food, not the induction field, since heat is generated in the utensil which itself becomes the burner. The utensil will in turn heat the surface on which it is located but the area surrounding the utensil will remain cool.

The circuitry for a magnetic induction unit includes the induction coil which is generally of a flat, spiral configuration. An inverter is used to generate an oscillatory magnetic field in the 25–30 kHz range and, because of the fast switching, a semiconductor is used as the inverter switch. Since the inverter can be supplying 15 amperes at 30 kHz, it is necessary to cool the circuitry to prevent overheating of the components. In some ranges forced ventilation is present and may be used to cool the circuitry as well as to perform its other functions. In a convertible cooktop range, even those with a proximity ventilation system, there is no provision for internally cooling/ventilating a cartridge and a proximity ventilation system is not intended to have such a function.

SUMMARY OF THE INVENTION

In the present invention, an induction cartridge is formed as a module containing induction heater(s) and the associated solid state circuitry as well as a ventilation fan. The ventilation fan is interlocked with the induction heater switch(es) so that whenever an induction heater is on, ambient air is drawn into the cartridge where it passes over and thereby cools the solid state components. When the air is exhausted from the cartridge, it passes between the cartridge and the range where it has a wiping action with respect to the underlying oven before being exhausted in a high velocity discharge from about the periphery of the cartridge.

It is an object of this invention to provide an induction cartridge which is interchangeable with other cartridges which plug into a common range top.

It is another object of the invention to provide an induction cartridge containing ventilating structure for cooling the solid state electronic circuitry.

It is a further object of this invention to provide an efficient cooling structure for the electrical circuitry of an induction cartridge. These objects, and others as will become apparent hereinafter, are accomplished by the present invention.

Basically, the present invention provides a self-contained induction cartridge which includes forced air circulating means for cooling the electrical components. The air flow path is such as to minimize recirculation by separating the inlets and outlets and by providing a high velocity exhaust.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
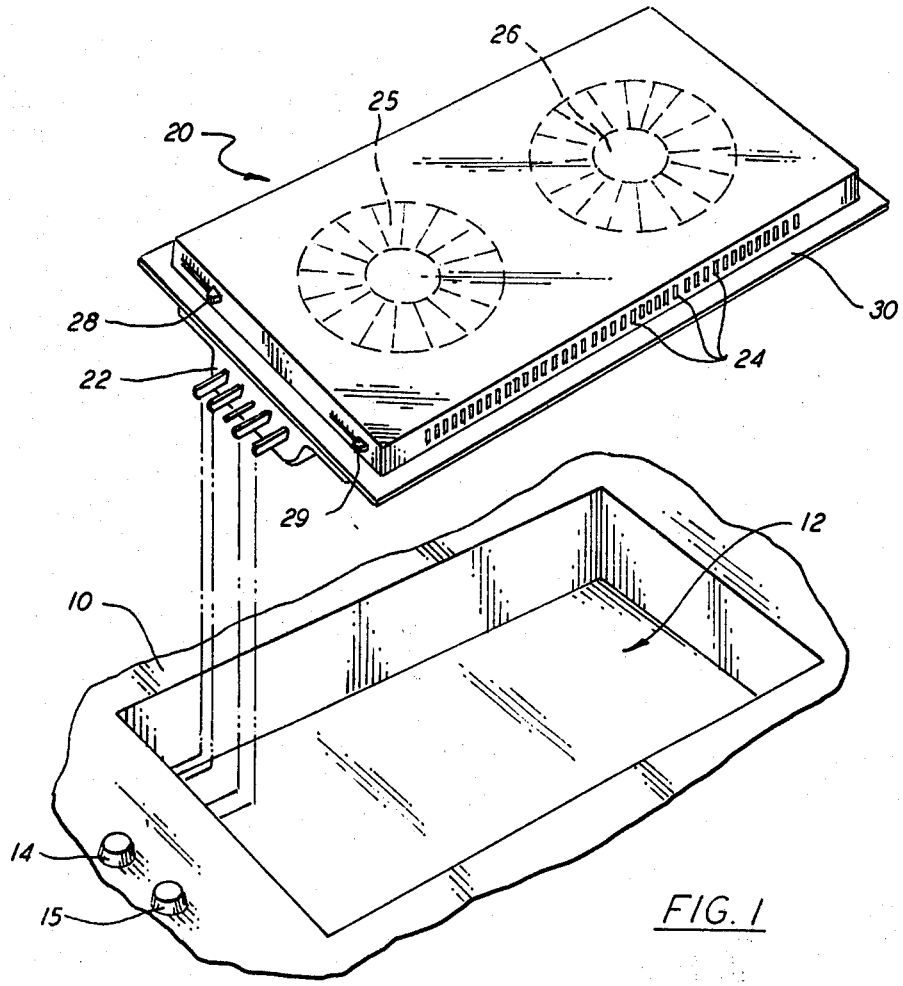
FIG. 1 is an exploded view of a portion of a range top adapted to selectively receive an induction cartridge.
Figure 6:
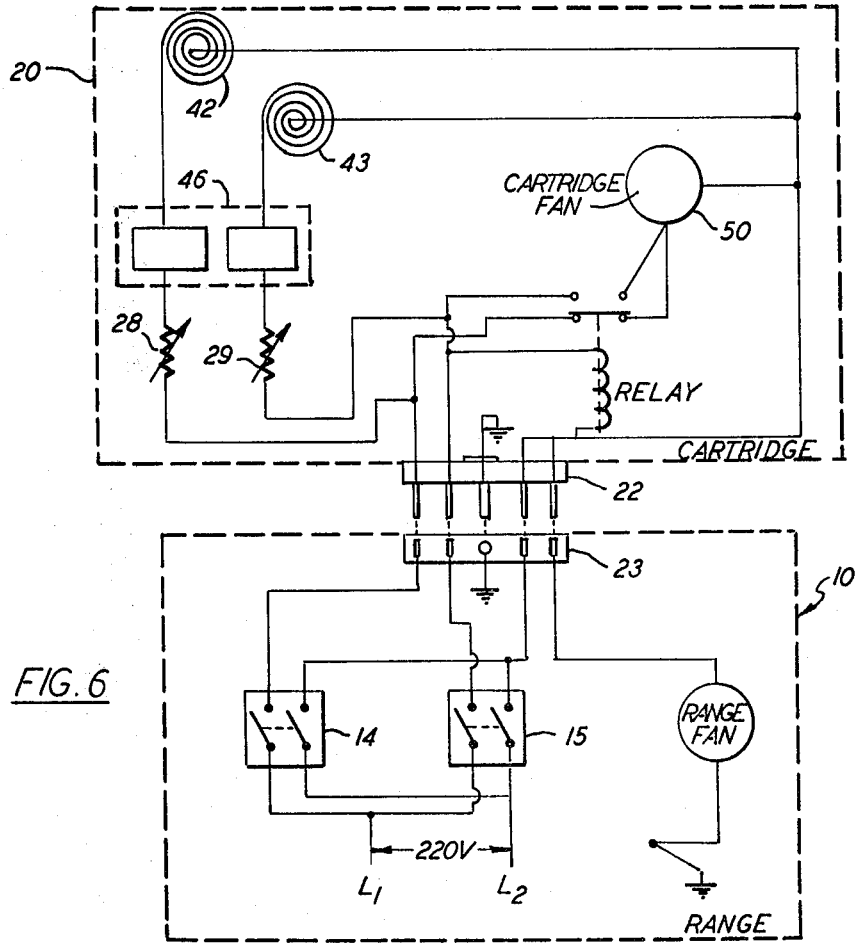
FIG. 6 is a schematic diagram of the electrical circuitry for the present invention when used in a proximity ventilating range.

In FIG. 1, the numeral 10 generally designates the surface of a range (either to free-standing range or counter drop-in type) provided with pan-like sheet metal recess means 12 for selectively receiving various cooking apparatus such as induction cartridge 20. Each of the cooking units, such as cartridge 20, is provided with a five-prong bayonet-type terminal 22 which is adapted to be removably received in electrical outlet means 23 (see FIGS. 4 and 6) in the front wall of recess means 12. The individual induction heaters of the cartridge 20 underlie the areas 25 and 26 and are controlled in an on-off fashion by panel switches 14 and 15 which are interlocked with a cartridge fan 50, as shown in FIG. 6. Regulated control of the induction coils of induction heaters 42 and 43, which underlie areas 25 and 26 of the glass top 40, is achieved through adjustment of infinitely variable switches 28 and 29, respectively.

Figure 2:
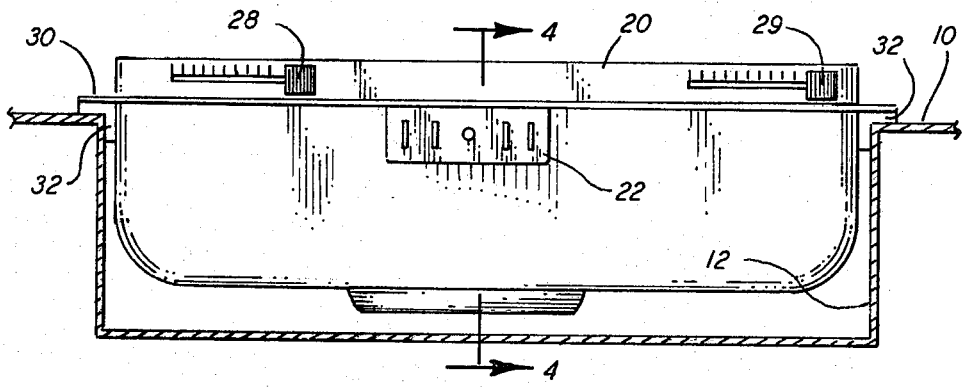
FIG. 2 is an end view of an induction cartridge.
Figure 3:
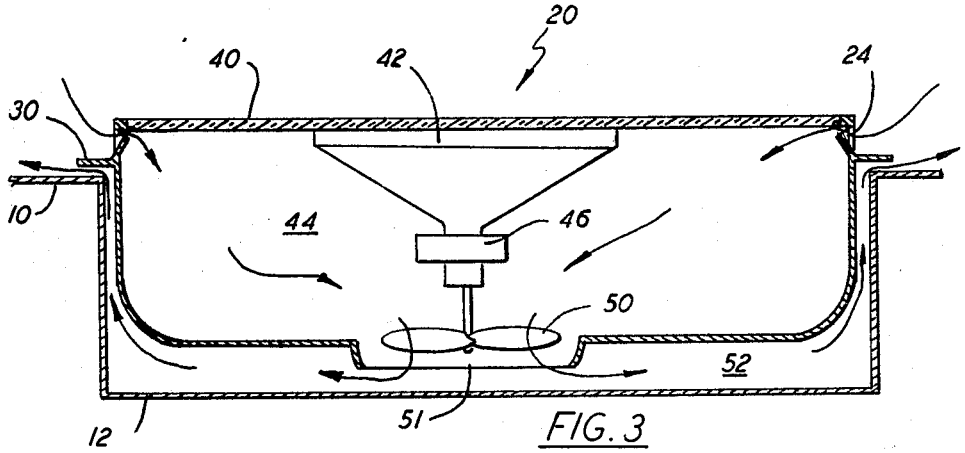
FIG. 3 is a sectional view corresponding to FIG. 2.
Figures 4, 5:
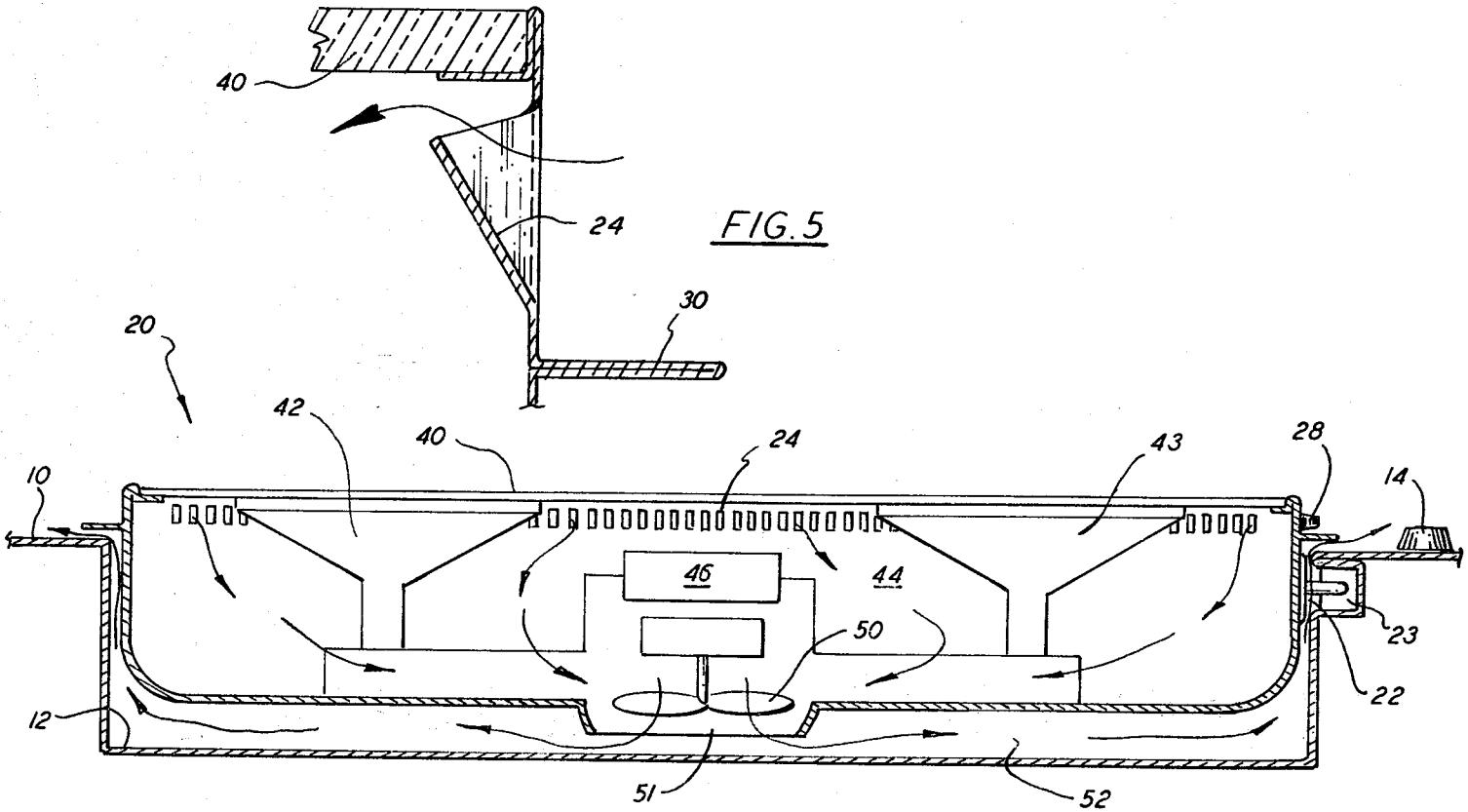
FIG. 4 is a sectional view taken along line 4—4 of FIG. 2.
FIG. 5 is an enlarged sectional view of a louver.

As is best seen in FIG. 2, the cartridge 20 has a peripheral flange 30 which is spaced from the surface of range 10 by a plurality of spacers 32. In a typical installation, four of the spacers 32 are present and located on the cartridge 20 in the vicinity of the corners. Referring now to FIGS. 3 and 4, the cartridge 20 has a glass top 40 with the induction coils of induction heaters 42 and 43 adjacent thereto and located in cavity 44. The solid state circuitry for operating the induction coils is generally designated 46 and no attempt has been made to illustrate all of the various components since their details form no part of the present invention and such circuits are known in the art. A cartridge fan 50 which is interlocked with panel switches 14 and 15 is also located in cavity 44 and is convered by a fan guard 51. As is best seen in FIGS. 1 and 4, a plurality of louvers 24 are formed in the long sides of cartridge 20 above the flange 30 and serve as air inlets. Because the louvers 24 are formed rather than punched out, and are recessed, as shown in FIG. 5, they are not subject to permitting spilled materials to enter the cavity 44. Fan 50 draws ambient air into the cavity 44 by way of louvers 24 and, in passing through the cavity 44, the air cools electrical components 46. Because fan 50 is interlocked with switches 14 and 15, fan 50 is on whenever switch 14 and/or 15 is on and independent of the setting of switches 28 and 29. Air exhausted by fan 50 passes into the cavity 52 formed between cartridge 20 and metal recess 12 and provides a wiping action as to the metal recess 12 which, typically, is subject to heating from an oven (not illustrated). Air passing from cavity 52 passes through the peripheral gap formed between flange 30 and surface 10, as a result of spacers 32, in a high velocity flow which is directed away from the inlets defined by louvers 24. Because of this spaced, high velocity outlet flow, mixing of inlet and exhaust air is minimized.

OPERATION

With bayonet-type terminal 22 of cartridge 20 operatively received in electrical outlet means 23, as illustrated in FIGS. 4 and 6, five electrical connections are established with the center connections being to chassis ground. The cartridge 20 is enabled by panel switches 14 and 15 which are double pole switches and serve an interlocked on-off function with respect to induction heaters 42 and 43 as well as to cartridge fan 50 so that fan 50 is on whenever switch 14 and/or 15 is on. The relay normally connects switch 14 with the fan 50 but connects switch 15 to the fan 50 whenever switch 15 is closed. When switches 14 and 15, or either of them, are on, the power to the induction heaters 42 and 43 is variably controlled by infinitely variable switches 28 and 29, respectively, which are illustrated in the form of variable resistors and are enabled by switches 14 and 15, respectively. The solid state circuitry 46 produces a 25–30 hKz signal in the coils of induction heaters 42 and 43 at an amperage dependent upon the position of switches 28 and 29, assuming switches 14 and 15 are on. If a utensil of a proper material, such as iron, is located on glass top 40, in area 25 or 26, adjacent the coil of induction heater 42 or 43, a current is induced therein so that the utensil acts as a burner to heat its contents. Simultaneously, ambient air is drawn through louvers 24 into the cavity 44 by fan 50.

The ambient air drawn into cavity 44 passes over and thereby cools the solid state circuitry 46 and then passes through fan 50 into the cavity 52 where the air provides a wiping action for pan-like recess means 12 which overlies and is subject to heating from an oven. The air then passes through the gap formed by spacers 32 between flange 30 and the surface of range 10 in a high velocity flow to minimize recirculation of the heated air.

Although a preferred embodiment of the present invention has been illustrated and described, other changes will occur to those skilled in the art. For example the infinitely variable switches in the cartridge may be replaced with infinite switches on the range surface which are used to control the input to the cartridge by changing the ratio of time on to time off. It is therefore intended that the scope of the present invention is to be limited only by the scope of the appended claims.

What is claimed is:

1. A cooking stove or range for selectively receiving cooking cartridge means comprising:

housing means having at least one pan-like member forming a recess;

cooking cartridge means having a top, bottom and sides defining a first cavity containing induction heating means and fan means and adapted to be operatively received in said recess;

flange means extending around the sides of said cartridge means and dividing said cartridge means into an upper and a lower portion;

spacer means secured to said cartridge means beneath said flange means and adapted to coact with said housing means to support said cartridge means so that said lower portion is received in said recess and spaced from said pan-like member to define a second cavity therebetween when said cartridge means is operatively connected, said spacer means further forming a gap between said flange means and said housing means to define an air outlet from said second cavity;

a plurality of ports on at least one side of said cartridge means and located in said upper portion for defining an air inlet to said first cavity within said cartridge means;

said cartridge means bottom defining an opening providing airflow communication between said first and second cavities, said fan means being operable for drawing air into said first cavity through said plurality of air inlet ports and passing it over and thereby cooling said induction heating means and directing the air through said opening into said second cavity formed between said cartridge means and said pan-like member and exhausting it through said air outlet gap.

2. The cooking stove as claimed in claim 1 wherein said upper portion of said cartridge means includes a plurality of ports on each of two opposing sides for defining air inlets to said first cavity and said opening in said cartridge means bottom is substantially centrally located on the bottom of said cartridge means.

3. An induction cartridge adapted for optional installation in a recess of cooking appliance supporting structure, the combination comprising:

enclosure means having a top, bottom and sides defining a cavity containing induction heating means and fan means;

disconnectable electrical connection means adapted to operatively connect said induction heating means and fan means to a source of power;

flange means extending around the sides of said enclosure means and dividing said enclosure means into an upper and a lower portion;

spacer means secured to said enclosure means beneath said flange means and adapted to support said enclosure means on said supporting structure and to define an airflow space therebetween;

a plurality of airflow ports on each of two opposing sides and located in said upper portion and exhaust means from said lower portion whereby when said fan means are operated, air is drawn into said cavity through at least said plurality of airflow ports and passes over and thereby cools said induction heating means whereupon the air passes through said fan means and out of said cavity.

4. A cooking stove or range for selectively receiving cooking cartridge means comprising:

a housing having at least one pan-like member forming a recess;

a cooking cartridge having a top, bottom and sides defining a first cavity containing induction heating means and fan means and adapted to be operatively received in said recess;

a flange extending around the sides of said cooking cartridge for dividing said cooking cartridge into an upper and a lower portion;

a plurality of spacers secured to the bottom of said flange and adapted to coact with said housing to support said cooking cartridge so that said lower portion is received in said recess and is spaced from said pan-like member to define a second cavity therebetween when said cooking cartridge is operatively connected, said spacers further forming a gap between said flange and said housing to define an air outlet from said second cavity;

a plurality of ports on each of two opposing sides of the upper portion of said cooking cartridge for defining air inlets to said first cavity within said cooking cartridge;

an exhaust opening substantially centrally located in the bottom of said cooking cartridge for providing airflow communication between said first and second cavities;

said fan means being operable for drawing air into said air inlet ports and passing it over and thereby cooling said induction heating means and directing the air through said exhaust opening into said second cavity and outwardly along the bottom wall of said cartridge and the recess pan-like member to said air outlet gap for effecting a further cooling of said cartridge bottom and said pan-like member.

5. A cooking appliance for selectively receiving cooking cartridge means comprising:

housing means having at least one pan-like member forming a recess, said pan-like member including side walls and a bottom wall;

cooking cartridge means having a top, bottom and sides defining a first cavity containing induction heating means and fan means and adapted to be operatively received in said recess;

means defining a supporting flange extending around the sides of said cartridge means and effectively dividing said cartridge means into an upper portion and a lower portion, said supporting flange adapted to coact with said housing means to support said cartridge means on said housing means with said lower portion disposed in said recess and said bottom spaced from said recess bottom wall to define a second cavity therebetween;

a plurality of ports in said upper portion for defining an air inlet to said first cavity;

an air outlet opening in said cartridge lower portion juxtaposed said fan for accommodating airflow from said first cavity;

and means defining an air exhaust conduit from said first cavity air outlet opening and extending to a position above said housing means spaced from said air inlet, said fan means being operable for drawing air into said first cavity through said plurality of air inlet ports and passing it over and thereby cooling said induction heating means and directing the air through said air outlet opening and said air exhaust conduit.

6. A cooking appliance as claimed in claim 5 wherein said air exhaust conduit is defined at least in part by said cartridge means bottom and said recess bottom wall.

7. A cooking appliance as claimed in claim 6 and further including spacer means secured beneath said flange means and engageable with said housing means for defining a gap between said flange means and said housing means to accommodate airflow from said air exhaust conduit.

8. A cooking appliance as claimed in claim 5 wherein said exhaust conduit includes said second cavity as defined by said cartridge bottom and said pan-like member and wherein said fan directs air from said first cavity into said second cavity before being exhausted therefrom.

9. A cooking appliance as claimed in claim 8 and further including spacer means secured beneath said flange means and engageable with said housing means for defining a gap between said flange means and said housing means to accommodate airflow from said second cavity.

* * * * *